US005911603A

United States Patent [19]

Mansutti

[11] Patent Number: 5,911,603

[45] Date of Patent: Jun. 15, 1999

[54] SINGLE PIECE ELECTRICAL RECEPTACLE TERMINAL FOR MATING WITH A PIN CONTACT

[75] Inventor: Patrick Mansutti, Cergy, France

[73] Assignee: The Whitaker Corporation, Wilmington, Del.

[21] Appl. No.: 08/889,385

[22] Filed: Jul. 8, 1997

[30] Foreign Application Priority Data

Jul. 22, 1996 [FR] France ..... 96401635

[51] Int. Cl.[6] ..... H01R 13/432

[52] U.S. Cl. ..... 439/748; 439/851

[58] Field of Search ..... 439/851, 852, 439/748, 744, 849, 856, 857, 842, 846, 880, 877, 845

[56] References Cited

U.S. PATENT DOCUMENTS

| | | | |
|---|---|---|---|
| 3,539,954 | 11/1970 | Camire | 439/851 |
| 3,966,295 | 6/1976 | Hyland et al. | 339/196 |
| 4,666,227 | 5/1987 | Galizia | 439/851 |
| 4,707,050 | 11/1987 | Konnemann | 439/851 |
| 5,271,741 | 12/1993 | Saito | 439/851 |

FOREIGN PATENT DOCUMENTS

| | | | |
|---|---|---|---|
| 0 390 865-B1 | 10/1990 | European Pat. Off. | H01R 13/11 |
| 0 700 124-A2 | 3/1996 | European Pat. Off. | H01R 13/428 |

*Primary Examiner*—Steven L. Stephan
*Assistant Examiner*—Javald Nasri

[57] ABSTRACT

A single piece electrical receptacle terminal comprises a pair of L-shaped contact arms disposed in opposed diagonal fashion for receiving a complementary pin terminal therein. A locking lance (52) is provided on a wall extension (50) that overlies a top wall (14) of the contact. The wall extension (40) is securely crimped to the top wall (14) in order to rigidify the box-shaped base section (8) of the contact. The provision of a locking lance (52) on the wall extension integral with the contact body ensures a single piece contact design requiring low material usage. The locking lance (52) is provided with the requisite flexibility by the double elasticity of the lance (52) itself and the adjacent support arms (58).

5 Claims, 4 Drawing Sheets

SINGLE PIECE ELECTRICAL RECEPTACLE TERMINAL FOR MATING WITH A PIN CONTACT

BACKGROUND OF THE INVENTION

1. Field of the Invention

This invention relates to an electrical receptacle terminal for mating with a pin terminal.

2. Description of the Prior Art

An effective receptacle terminal for mating with a contact pin is described in European patent EP 390 865-B1. The terminal described therein comprises an inner contact having opposed L-shaped contact arms defining four contact points surrounding a pin terminal mated therewith. A pair of contact arms separated by a slot thus form each of the L-shaped arms, whereby a particularly high contact force is provided by interconnecting the pair of contact arms at a mating end of terminal. The contact arms extending from each of the four walls of the box-shaped base section of the contact, and an outer spring body is provided therearound, the outer spring body having a resilient locking lance for securing the terminal in a connector housing cavity. The outer body is typically made of a material, such as stainless steel, that has better elastic properties than the material of the inner contact body, and is thus better adapted for provision of a locking lance and securing of the terminal in a housing. It is however more expensive to provide a two-part terminal than a single piece terminal.

It would be desirable to provide a receptacle contact with the advantageous contact arms of the terminal described in EP 390 865 in a particularly cost-effective manner, whilst nevertheless enabling secure and reliable retention of the terminal within the cavity of the housing.

SUMMARY OF THE INVENTION

It is an object of this invention to provide a cost-effective receptacle terminal which retains the advantageous contact properties of the terminal according to EP 390 865.

The object of this invention has been achieved by providing the terminal according to claim 1. Advantageously, the single piece stamped and formed electrical terminal according to claim 1 is particularly cost-effective, particularly in view of the low material usage and production from a single piece of sheet metal, whilst nevertheless providing opposed L-shaped contact arms attached to a box-shaped base section. The box-shaped base section can be rigidly closed for producing high contact force. A further advantage derives from providing a particularly supple locking lance on a single wall extension that requires low material usage.

Further advantageous aspects of the invention will be apparent from the following description and claims.

DETAILED DESCRIPTION OF THE PREFERRED EMBODIMENT

Figure 1:
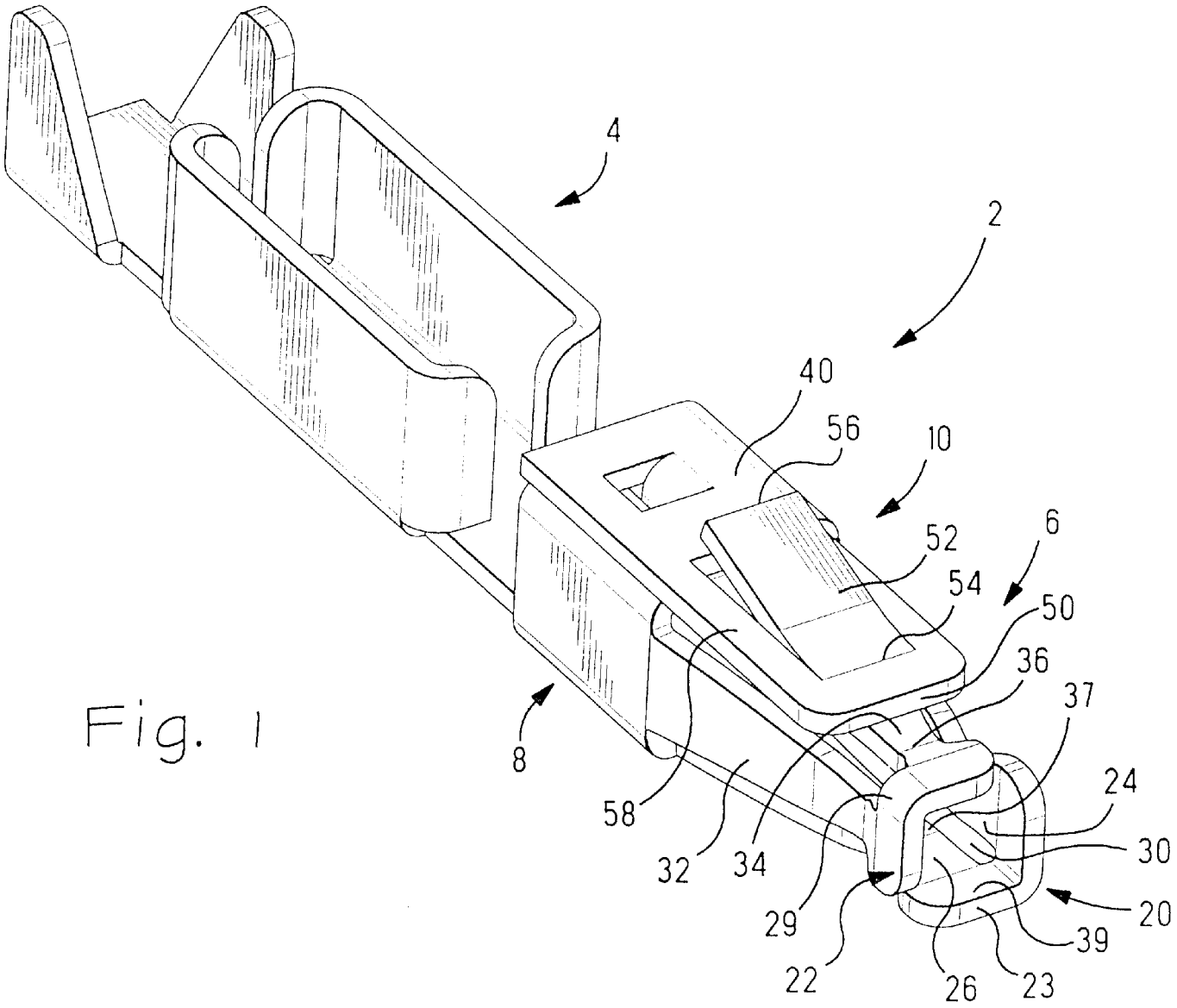
FIG. 1 is an isometric view of a terminal according to this invention.
Figure 2:
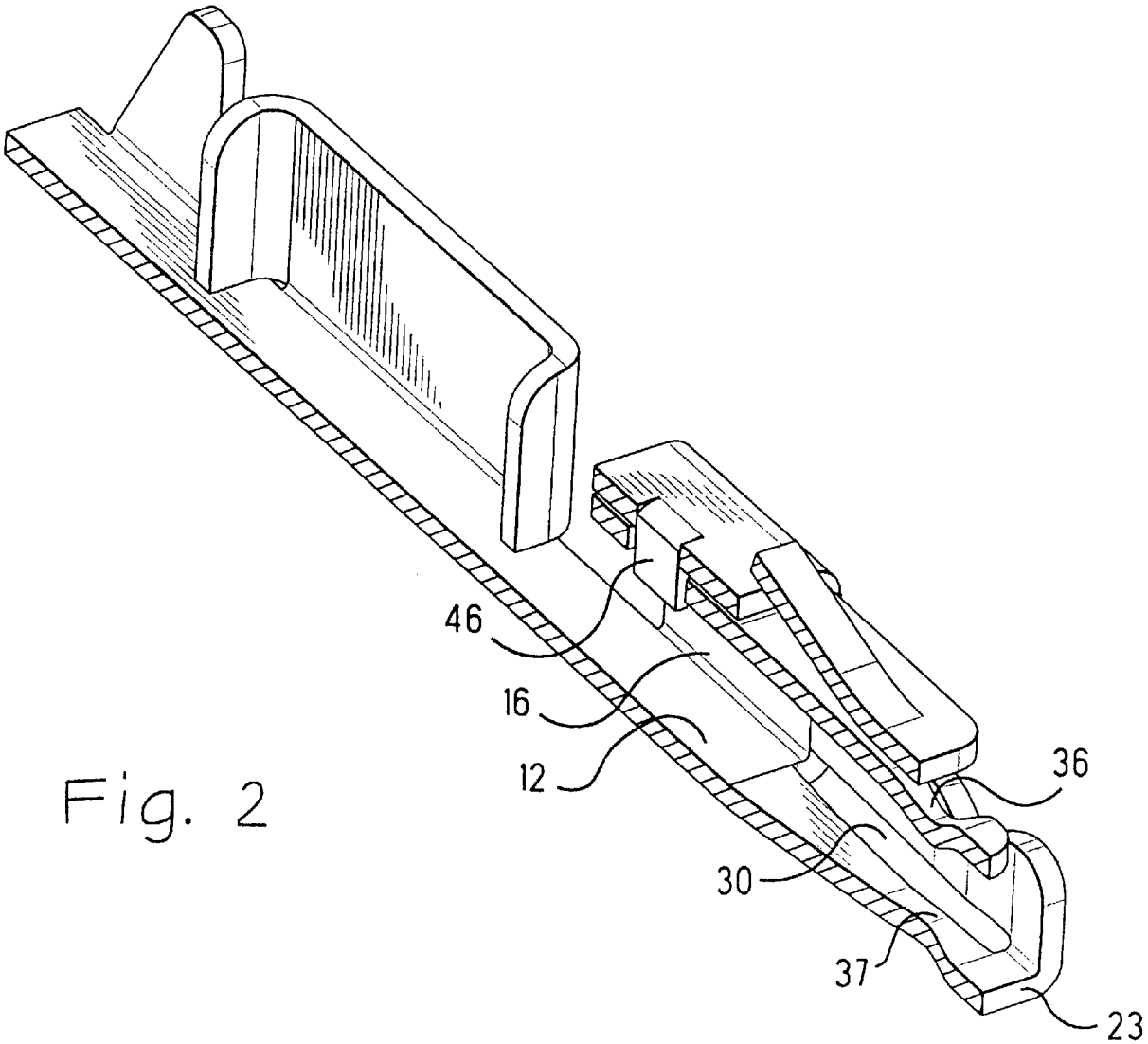
FIG. 2 is an isometric cross-sectional view of the terminal of FIG. 1.
Figure 3:
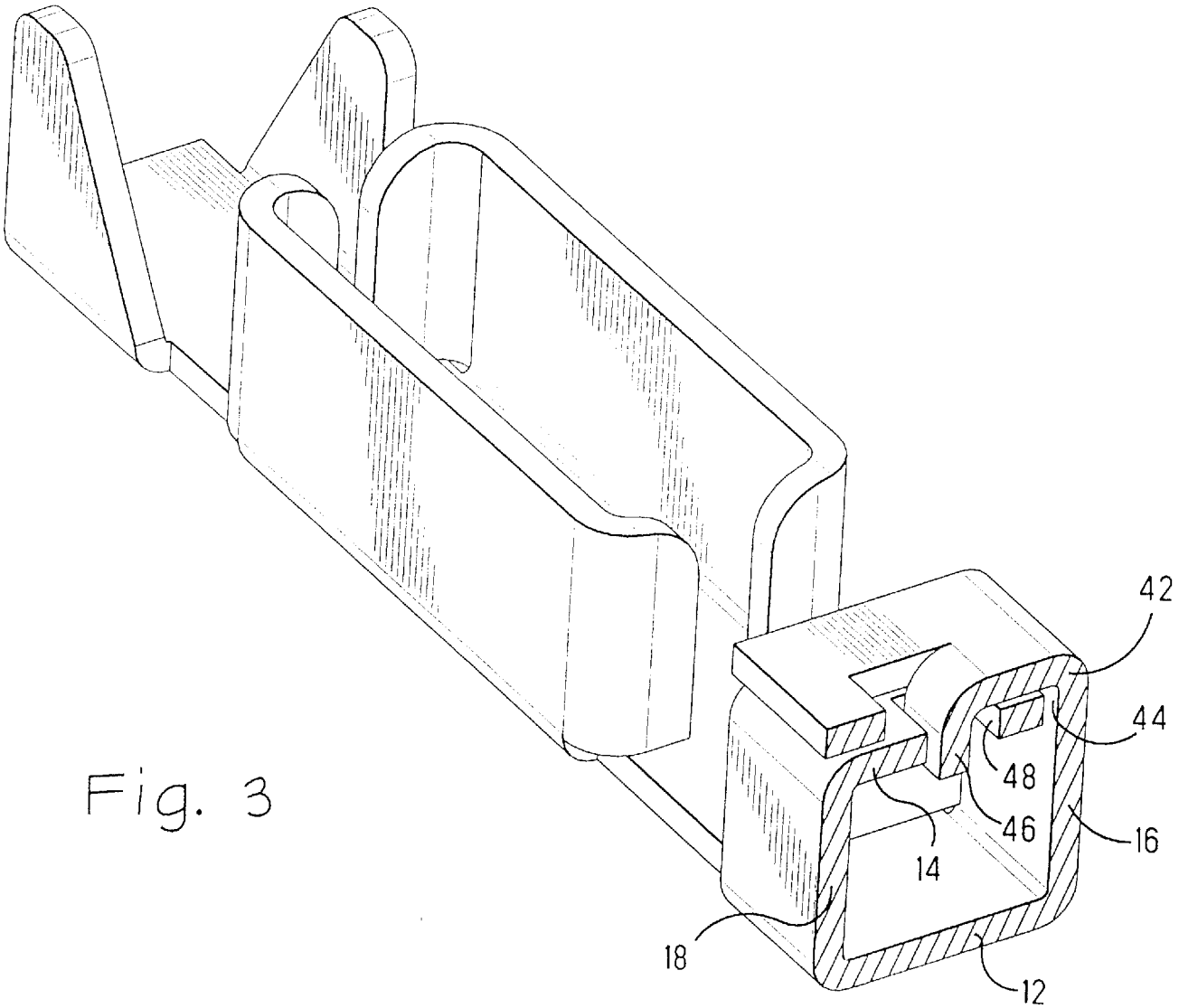
FIG. 3 is an isometric cross-sectional view through a box-shaped base section of the terminal.
Figure 4:
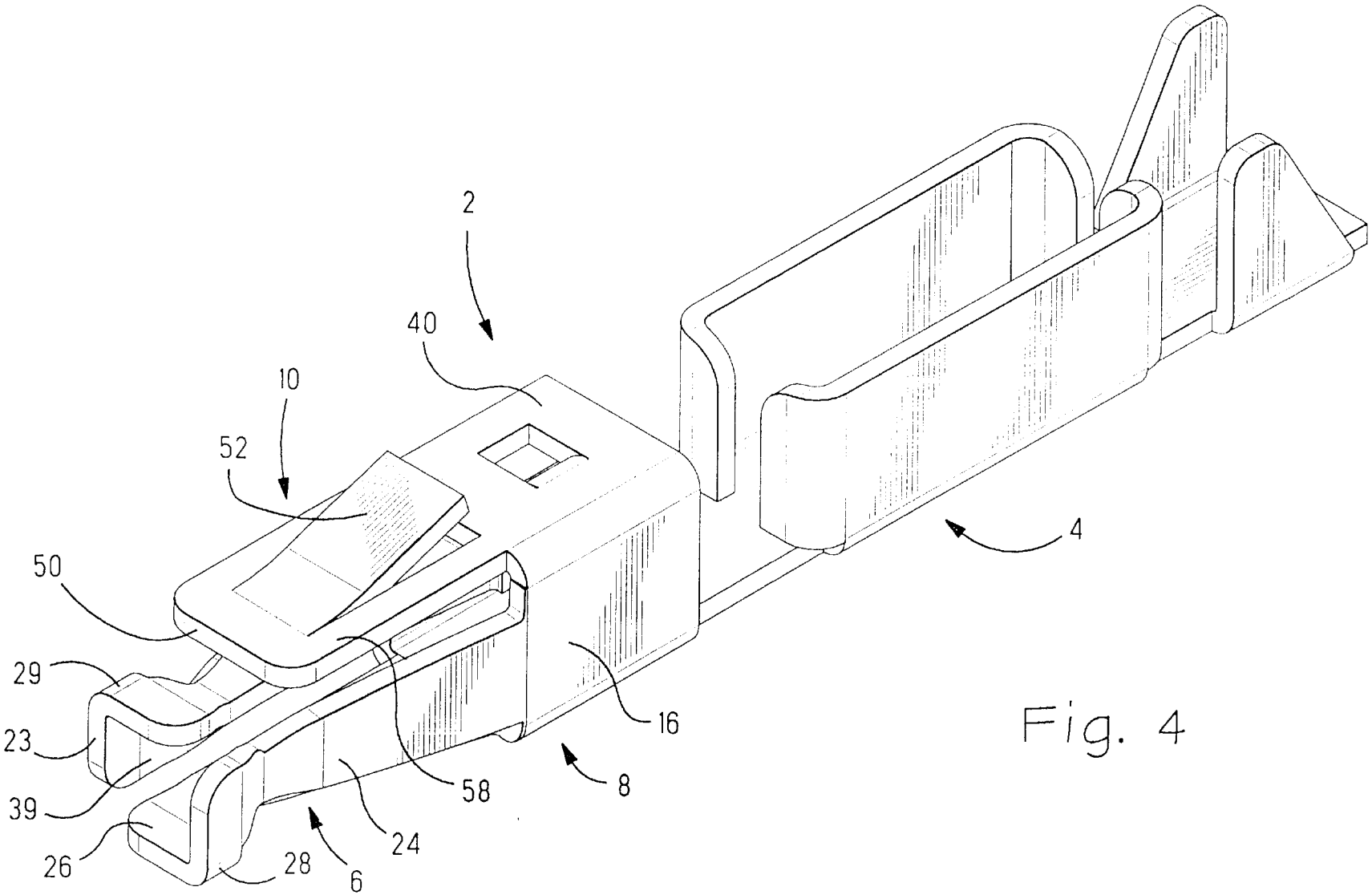
FIG. 4 is an isometric view of the terminal from another side to that of FIG. 1.

Referring to the figures, an electrical receptacle terminal 2 comprises a connection section 4 for connection to a conducting wire, a contact section 6 for mating with a complementary pin terminal, a base section 8 interconnecting the contact section 6 to the connection section 4, and a retention section 10 for securing the terminal within a connector housing (not shown). The base section 8 is substantially box-shaped and comprises a bottom wall 12, a top wall 14 opposed thereto, and side walls 16,18 extending between the top and bottom walls.

The contact section 6 comprises a first contact arm pair 20 and a second contact arm pair 22 positioned diagonally opposite the first contact arm pair. The first contact arm pair 20 comprises a first contact arm extending from the bottom wall 12 of the base portion, to a mating end 23 of the terminal, and a second contact arm extending from the side wall 16 to the mating end 23, the contact arms being joined proximate the mating end 23 by an L-shaped bridging portion 28. The contact arms 24,26 of the contact arm pair 20 are separated by a slot 30 extending from the base section to the bridging portion 28 at the mating end 23. The contact arm pair 22 is similarly constructed to the contact arm pair 20 comprising contact arms 32,34 joined by the bridging portion 29. Each of the contact arms is provided with an inwardly bowed section 36 forming a contact protrusion 37. A mating pin terminal is thus received and guided in the four walled funnel-shaped entry portion 39 of the terminal extending between the mating end 23 and the contact protrusions 37, subsequently biasing apart the contact arm pairs during insertion past the contact protrusions 37. Linking together of the contact arm pairs by the bridging portions 29, 28 provides the contact arms with high spring force for producing high contact pressure against the mating terminal. In addition, the four contact points 37 assist in guiding and locating the pin terminal within the receptacle.

The retention section 10 comprises a wall extension 40 that is integrally attached through a corner portion 42 to one of the side walls 16. The wall extension 40 overlies the top wall 14 of the base section 8. The top wall 14 joins the side wall 16 at a seam 44. The wall extension 40 comprises a locking tab 46 crimped to the top wall 14 through a cutout 48 thereof. The crimping of the wall extension 40 to the top wall 14 provides a robust and rigid box-shaped structure of the base 8 that enhances the contact force of the contact arms. The wall extension 40 extends in the direction towards the mating end 23 to a free end 50 positioned in a region above the inwardly bowed contact portion 36 of the contact arm 34. A large inward deflection of the free end 50 of the extension is thus possible. This is particularly advantageous for providing a compact but flexible locking lance. A locking lance 52 projects obliquely outwardly and rearwardly from the wall extension, and is attached proximate the free end 50 at an attachment end 54, and extends to a free end 56. Upon insertion in a cavity of a connector housing, the free end 56 of the lance is resiliently inwardly biased. Resiliency is provided not only by the locking lance 52, but by the support arms 58 extending either side of the lance and resulting from stamping out of the lance 52 from the wall extension. Apart from the locking lance 52 and the locking tab 46, the wall extension 40 is a substantially planar member provided only one side of the box-shaped contact. As a result of the latter, additional material for provision of the wall extension and the locking lance is limited to a minimum.

The resilience provided by the lance 52 and lateral support arms 58 enable the lance to be provided in a particularly compact manner out of the material of the inner contact with nevertheless the requisite flexibility and enhanced reliability. Simultaneously, the wall extension secures the box by means of the secure locking means 46,48 to provide a rigid base section that enhances the contact force of the contact arms.

I claim:

1. An electrical terminal stamped and formed from sheet metal for mating with a pin terminal, comprising a connection section, a contact section and a base section therebetween, the base section being box-shaped and comprising a bottom wall, a top wall opposed thereto, and side walls, the contact section comprising a contact arm extending from each of the walls of the base section to a mating end, a first pair of the contact arms joined together at the mating end by a bridging portion, and a second pair of the contact arms being joined together at the mating end by a bridging portion diametrically disposed with respect to the first bridging portion, characterized in that the terminal comprises a wall extension integrally extending from one of the side walls via a corner portion over the top wall, the wall extension comprising a resilient locking member extending beyond the base section to a free end proximate the mating end.

2. The terminal according to claim 1 wherein the free end of the wall extension is positioned in a region above an inwardly bowed contact portion of the contact arm extending from the top wall.

3. The terminal according to claim 1 wherein the locking member comprises a resilient lance outwardly stamped from the wall extension, attached at one end proximate the free end of the extension and extending obliquely outwardly to a free end towards the connection section, the locking member further comprising a lateral support arm extending alongside the lance and interconnecting the attached end to a portion of the wall extension overlying the top wall.

4. The terminal according to claim 1 wherein the wall extension is securely attached to the base section top wall.

5. The terminal according to claim 4 wherein the wall extension is crimped, by means of a locking tab engaging in a cutout, to the top wall.

* * * * *